US006394522B1

(12) United States Patent
Ingoldt

(10) Patent No.: US 6,394,522 B1
(45) Date of Patent: May 28, 2002

(54) MAGAZINE FOR ROAD FLARES

(76) Inventor: Bruce F. Ingoldt, 2935 Alamitos Pl., Escondido, CA (US) 92027

( * ) Notice: Subject to any disclaimer, the term of this patent is extended or adjusted under 35 U.S.C. 154(b) by 0 days.

(21) Appl. No.: 09/532,312

(22) Filed: Mar. 22, 2000

(51) Int. Cl.[7] ..... B65D 71/00

(52) U.S. Cl. ..... 294/143; 102/343; 206/803; 246/488; 294/159

(58) Field of Search ..... 294/5.5, 87.1, 294/87.11, 87.2, 87.28, 99.1, 137, 141–144, 146, 148, 159, 161–163, 165, 166; 102/343, 358; 206/443, 573, 803; 211/60.1; 246/488

(56) References Cited

U.S. PATENT DOCUMENTS

| | | | | | |
|---|---|---|---|---|---|
| 844,481 | A | * | 2/1907 | Stewart | 246/488 |
| 1,344,564 | A | * | 6/1920 | Rodenbur | 246/488 |
| 1,448,866 | A | * | 3/1923 | Redoute | 294/143 X |
| 1,526,349 | A | * | 2/1925 | Langenbacker | 246/488 |
| 2,080,947 | A | * | 5/1937 | Ligeour | 294/87.2 |
| 2,220,407 | A | * | 11/1940 | Joss | 206/803 X |
| 2,487,109 | A | * | 11/1949 | Deichert | 294/87.2 |
| 2,615,749 | A | * | 10/1952 | Kuchel | 294/159 X |
| 3,003,805 | A | * | 10/1961 | Glazer | 294/87.2 |
| 3,254,756 | A | * | 6/1966 | Rankin | 206/803 X |
| 3,563,432 | A | * | 2/1971 | Sage et al. | 294/159 X |
| 3,611,934 | A | * | 10/1971 | Schaefer | 206/803 X |
| 5,012,923 | A | * | 5/1991 | Hayes | 206/803 X |

* cited by examiner

*Primary Examiner*—Johnny D. Cherry
(74) *Attorney, Agent, or Firm*—Calif Tervo

(57) ABSTRACT

A magazine for holding and distributing a plurality of road flares has a bottom including downwardly facing sockets for receiving ends of a plurality of road flares and for retaining the received flares against the force of gravity but such that each retained flare may be plucked out by hand for lighting and distribution. A top includes a carrying handle adapted for cradling a lit starter flare such that the flare can be held to the handle by a carrying hand and released as desired by releasing the flare from the carrying hand and tilting the handle. Preferably, the ignition end of the flare is inserted in the socket and a cap and/or anti-roll device is placed on the other end of the flare.

16 Claims, 2 Drawing Sheets

FIG. 1
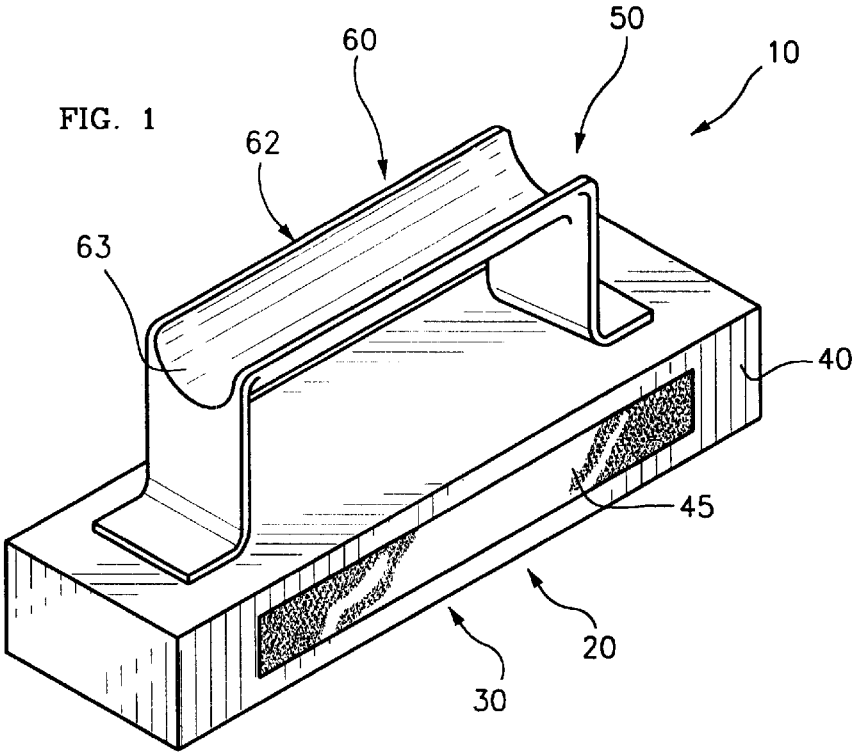
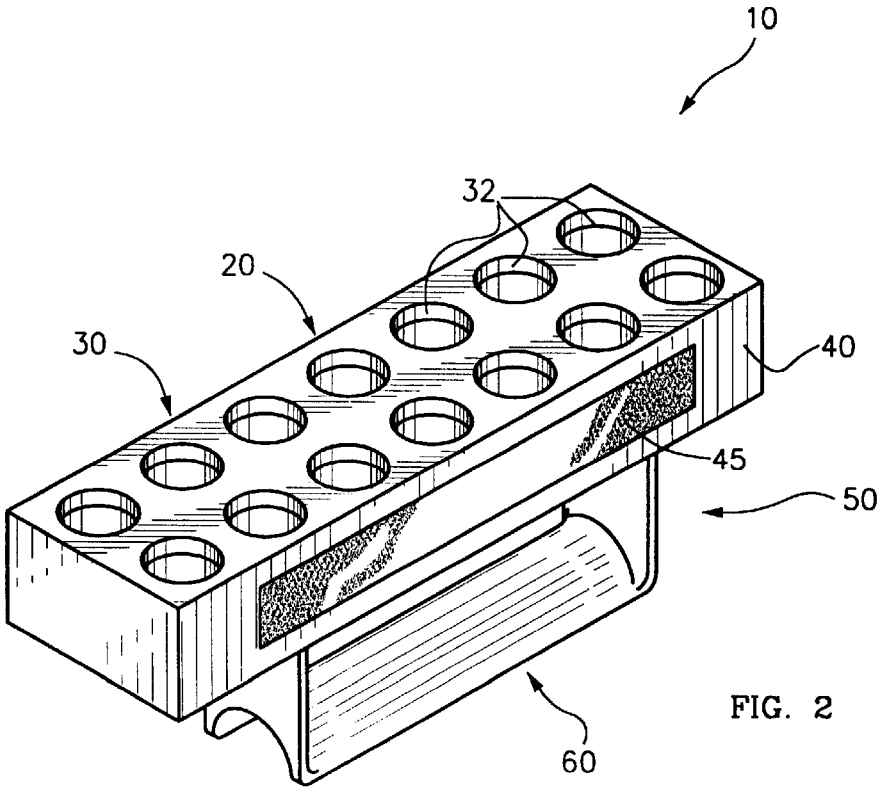
FIG. 2

MAGAZINE FOR ROAD FLARES

FIELD OF THE INVENTION

This invention relates to a magazine for holding and a method of distributing a plurality of road flares.

BACKGROUND OF THE INVENTION

Conventionally, at an incident, such as a traffic accident, a person distributing road flares grabs a bunch of flares from a shipping/storage container. Typically, flares have a protective cap over the ignition end. The cap also typically functions as an anti-roll device.

Valuable time is taken in removing the protective caps and placing them on the opposite ends of the flare. Carrying the desired number of flares at an incident and lighting and distributing a flare while holding a bunch of flares is difficult and distracting. Fumbling with flares at an incident distracts the distributor from observing potential threats to safety and slows the person from performing other valuable services.

Therefore, there has been a need for a device to aid in distributing road flares.

SUMMARY OF THE INVENTION

This invention is a magazine for holding and distributing a plurality of road flares. The magazine has a bottom including downwardly facing sockets for receiving ends of a plurality of road flares and for retaining the received flares against the force of gravity but such that each retained flare may be plucked out by hand for lighting and distribution. A top includes a carrying handle adapted for cradling a lit starter flare such that the flare can be held to the handle by a carrying hand and released as desired by releasing the flare from the carrying hand and tilting the handle. Preferably, the ignition end of the flare is inserted in the socket and a cap and/or anti-roll device is placed on the other end of the flare.

Other features and advantages of the invention will be readily understood when the detailed description thereof is read in conjunction with the accompanying drawings wherein like reference numerals refer to like parts throughout.

BRIEF DESCRIPTION OF THE DRAWINGS

FIG. 1 top perspective view of a preferred embodiment of the magazine for road flares of the invention.

FIG. 2 is a bottom perspective view of the magazine of FIG. 1.

DETAILED DESCRIPTION OF THE INVENTION

Figure 3:
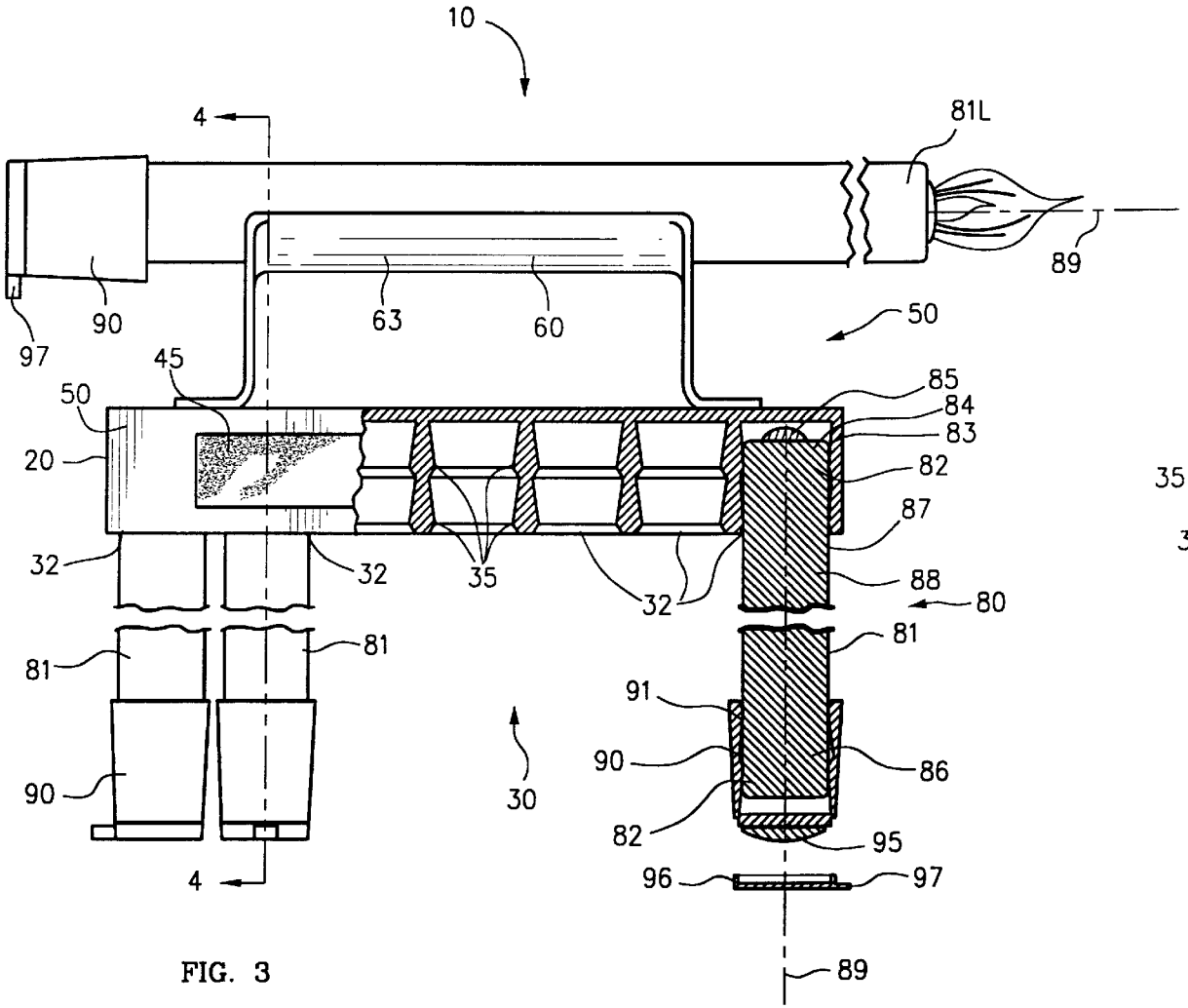
FIG. 3 is an enlarged, partially cut away, left side view of the magazine of FIG. 1 further showing the magazine partially loaded with road flares and including a starter flare on the top.

With reference now to the drawings, and first to FIG. 3 thereof, there is shown partially cut away, a road flare 80, such as common elongate cylindrical flare 81. Flare 81 generally comprises a cover or shell 87, generally made of paper, encapsulating an internal mass of incendiary material 88. Flare 81 has ends 82, such as a first end 83, such as ignition end 84, and a second end 86, and a longitudinal axis 89 between ends 83, 86. A typical flare 81 with a 20-minute burn time has a diameter of about 25 mm and a length of 290 mm. Ignition end 84 terminates in an ignitor 85 used to ignite the flare, typically by striking ignitor 85 against a frictional surface. Although flares 81 of cylindrical cross section have been shown and described, flares 80 may have another type of cross section, such as triangular, square, octagonal or the like.

Typically, during shipping and storage of flares 81, the ignition end 84 and ignitor 85 are covered with a cap 90 of plastic. Cap 90 includes an internal cavity 91 for frictional attachment over an end 82 of flare 81. Cap 90 includes a friction surface 95 for striking ignitor 85, thereby igniting flare 81. Friction surface 95 is covered by a,protective cover 96. An anti-roll means, such as radial tab 97 on cover 96 of cap 90, prevents flare 81 from rolling away from the position in which it is placed during use.

FIG. 1 is a top perspective view of a preferred embodiment of magazine 10 and in FIG. 2 is a bottom perspective view of magazine 10 of FIG. 1. Magazine 10 generally includes a bottom 20 and a top 50 connected to bottom 20. Bottom 20 includes downwardly facing receptacle means 30, such as a plurality of sockets 32, each for holding a road flare 80. Top 50 includes a carrying handle 60 adapted for holding an ignited starter flare 81L. The outer surface 40 preferably includes one or more surfaces, such as friction surfaces 45, upon which ignition end 84 of a flare 80 may be struck to ignite flare 80.

Figure 4:
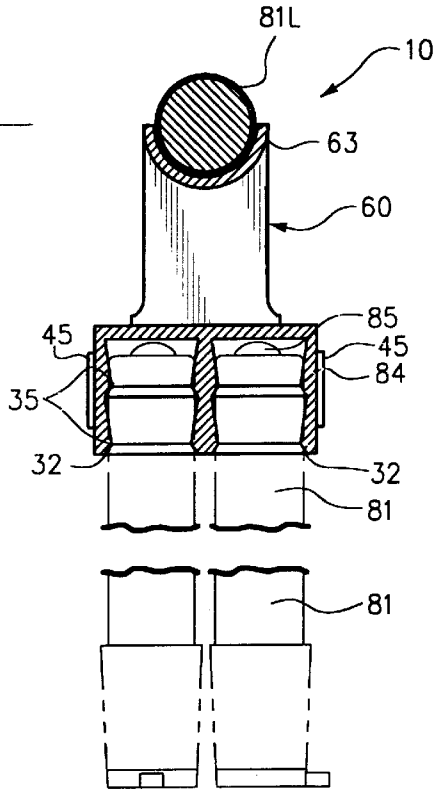
FIG. 4 is a sectional view taken on line 4—4 of FIG. 3.

Turning now to FIGS. 3 and 4, FIG. 3 is an enlarged, partially cut away, left side view of magazine 10 of FIG. 1 further showing magazine 10 partially loaded with road flares 81 and FIG. 4 is a sectional view taken on line 4—4 of FIG. 3.

Magazine 10, shown, has two rows of seven sockets 32. Other numbers and configurations may be used. Also, although round sockets 32 are shown, other shapes adapted to receive a flare 80 are contemplated.

Sockets 32 for receiving a flare 81 each include means, such as internal resilient ridges 35, for gripping an end 82 of a flare 81 and for retaining the received flare 81 against the force of gravity but such that each retained flare 81 may be plucked from socket 32 by hand.

Top 50 includes holding means 62 for holding an ignited starter flare 81L, preferably such that longitudinal axis 89 of starter flare 81L is horizontal. In the preferred embodiment, shown, carrying handle 60 is adapted for cradling lit flare 81 by including upwardly open trough means, such as trough 63, for receiving starter flare 81L such that starter flare 81L can be held to handle 60 by a carrying hand.

Magazine 10 is loaded with flares 81 and then is used to distribute the loaded flares 80. A preferred loading method is now described. A flare 81 is removed from a storage or shipping container, and cap 90 is removed from ignition end 84 and placed on second end 86. Ignition end 84 is inserted into a socket 32. This is repeated until magazine 10 is full or is carrying the desired number of flares for the job. The loaded magazine 10 can be easily carried by a hand on handle 60. A loaded magazine 10 can even be set down on lower ends, i.e. second ends 86, of retained flares 81 such that the whole combination stands upright.

When it is time for the loaded magazine to be used, a starter flare 81L is taken from the shipping container or removed from a socket 32 and placed in handle trough 63 and held in place by the carrying hand. Starter flare 81L is ignited such as by plucking flares 81 from sockets 32 as needed, and they are ignited by starter flare 81L and distributed. A lit starter flare 81L can be dropped at any time by simply releasing it and tilting magazine 10. Should the distributor have to abandon the distribution and magazine 10 at any time during distribution, the distributor can lay down magazine 10, releasing lit starter flare 81L from handle trough 63 such that released starter flare 81L is displaced a short distance from handle 50 such that the displaced lit starter flare 81L will burn down without burning magazine 10 or loaded flares 81. If an ignited end of starter flare 81L burns down so as to approach handle 60, starter flare 81L is distributed and it is replaced with another new starter flare.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A magazine for a plurality of road flares; each road flare having: a longitudinal axis; a first end; and a second end; said magazine comprising:

a bottom including:

downwardly facing receptacle means for receiving the first ends of a plurality of road flares and for retaining the received flares against the force of gravity but such that each retained flare may be plucked from said receptacle means by hand; and a top connected to said bottom including:

a carrying handle; and holding means for holding a lit flare.

2. The magazine of claim 1 wherein:

said downwardly facing receptacle means includes a plurality of sockets; each socket adapted for receiving a first end of a road flare.

3. A magazine for a plurality of road flares; each road flare having: a longitudinal axis; a first end; and a second end; said magazine comprising:

a bottom including:

downwardly facing receptacle means for receiving the first ends of a plurality of road flares and for retaining the received flares against the force of gravity but such that each retained flare may be plucked from said receptacle means by hand; and a top connected to said bottom including:

a carrying handle; and a striking surface upon which the ignition end of a flare having an ignition end may be struck to ignite the flare.

4. The magazine of claim 3 wherein:

said downwardly facing receptacle means includes a plurality of sockets; each socket adapted for receiving a first end of a road flare.

5. A magazine for a plurality of road flares; each road flare having: a longitudinal axis; a first end; and a second end; said magazine comprising:

a bottom including:

downwardly facing receptacle means for receiving the first ends of a plurality of road flares and for retaining the received flares against the force of gravity but such that each retained flare may be plucked from said receptacle means by hand; and a top connected to said bottom including:

a carrying handle including:

trough means for receiving a lit flare such that the flare can be held to said handle by a carrying hand.

6. The magazine of claim 5 wherein:

said downwardly facing receptacle means includes a plurality of sockets; each socket adapted for receiving a first end of a road flare.

7. A magazine for a plurality of road flares; each road flare having: a longitudinal axis; a first end; and a second end; said magazine comprising:

a bottom including:

downwardly facing receptacle means for receiving the first ends of a plurality of road flares and for retaining the received flares against the force of gravity but such that each retained flare may be plucked from said receptacle means by hand; and a top connected to said bottom including:

a carrying handle including:

upwardly open trough means for supporting a lit flare.

8. The magazine of claim 7 wherein:

said downwardly facing receptacle means includes a plurality of sockets; each socket adapted for receiving a first end of a road flare.

9. In combination:

a plurality of road flares; each road flare having: a longitudinal axis; a first end; and a second end; and a magazine comprising:

a bottom including:

downwardly facing receptacle means retaining the first ends of said plurality of road flares against the force of gravity but such that each retained flare may be plucked from said receptacle means by hand; and a top connected to said bottom including: a carrying handle.

10. The combination of claim 9 wherein:

said downwardly facing receptacle means includes a plurality of sockets; each socket for receiving a first end of a road flare.

11. The magazine of claim 9 wherein:

said top includes:

holding means for holding a lit flare.

12. The magazine of claim 9 wherein:

said carrying handle includes:

upwardly open trough means for supporting a lit flare.

13. The magazine of claim 9 wherein:

said carrying handle includes:

upwardly open trough means for supporting a lit flare such that the flare can be held to said handle by a carrying hand and released from said handle by releasing the flare from the carrying hand and tilting said handle.

14. A method of distributing road flares with a magazine; each road flare having: a longitudinal axis; a first end and a second end; the magazine comprising: a bottom including: downwardly facing receptacle means for retaining the first ends of the plurality of road flares against the force of gravity but such that each retained flare may be plucked from the receptacle means by hand; and a top connected to the bottom including: a carrying handle; and holding means for holding a lit flare; the method comprising the steps of:

inserting the first ends of a plurality of flares in the receptacle means;

placing a starter flare in the holding means;

igniting the starter flare;

carrying the magazine by the handle;

plucking inserted road flares from the receptacle means;

lighting plucked road flares from the ignited starter flare; and distributing the lit flares.

15. The method of claim 14 wherein each flare first end is an ignition end including a cap and further including the step of:

removing the cap from each ignition end before the step of inserting the ignition end in the receptacle means.

16. The method of claim 15 further including the step of:

placing the cap removed from an ignition end on a second end.

* * * * *